US008079322B2

(12) United States Patent
Carpenter

(10) Patent No.: US 8,079,322 B2
(45) Date of Patent: Dec. 20, 2011

(54) SHOCK TUBE

(75) Inventor: David A. Carpenter, Clarksville, MD (US)

(73) Assignee: AAI Corporation, Hunt Valley, MD (US)

( * ) Notice: Subject to any disclaimer, the term of this patent is extended or adjusted under 35 U.S.C. 154(b) by 367 days.

(21) Appl. No.: 12/504,977

(22) Filed: Jul. 17, 2009

(65) Prior Publication Data

US 2010/0011981 A1 Jan. 21, 2010

Related U.S. Application Data

(60) Provisional application No. 61/129,758, filed on Jul. 17, 2008.

(51) Int. Cl.
*F41A 33/00* (2006.01)
*F42B 8/00* (2006.01)

(52) U.S. Cl. ..... 116/23; 434/11; 102/498

(58) Field of Classification Search ..... 116/22 R, 116/23, 137 A, 142 FP; 367/144; 434/11; 102/355, 407, 498
See application file for complete search history.

(56) References Cited

U.S. PATENT DOCUMENTS 3,065,798 A 11/1962 Pearson et al.
3,334,425 A 8/1967 Ohlund
3,415,442 A * 12/1968 Stoddard et al. ..... 417/392
5,505,081 A * 4/1996 Lacey et al. ..... 73/147
6,439,891 B1 8/2002 Tate et al.
6,553,912 B2 4/2003 Wygant
6,570,820 B2 * 5/2003 Patel et al. ..... 367/144
7,317,662 B2 * 1/2008 Unsworth et al. ..... 367/144
2007/0169658 A1 7/2007 Brock

OTHER PUBLICATIONS

International Search Report and Written Opinion dated Sep. 3, 2009, directed to counterpart PCT/US2009/050972 application. (9 pages).

* cited by examiner

*Primary Examiner* — Amy Cohen Johnson
(74) *Attorney, Agent, or Firm* — Venable LLP; Jeffri A. Kaminski; Steven J. Schwarz

(57) ABSTRACT

A shock tube apparatus may include a plenum to hold a volume of gas. The plenum may include a hollow chamber having a first end and a second end located opposite one another along a longitudinal axis, the first end of the chamber defining a shock egress opening. A valve assembly may be positioned at the first end of the chamber to seal the shock egress opening. A piston may be positioned within a recess located at the second end of the chamber. The piston may separate a first volume located between the piston and the first end of the chamber from a smaller second volume located between the piston and the second end of the chamber. A tension supporting rod may connect the valve assembly to the piston. A release valve may be in fluid connection with the second volume and a switch may be operable to open the release valve to release gas from the second volume and trigger opening of the valve assembly to generate a shock wave through the shock egress opening.

19 Claims, 6 Drawing Sheets

SHOCK TUBE

CROSS-REFERENCE TO RELATED APPLICATIONS

The present application claims the benefit under 35 U.S.C. §119(e) of U.S. Provisional Patent Application No. 61/129,758, filed on Jul. 17, 2008. The contents of the foregoing application is expressly incorporated herein by reference in its entirety.

BACKGROUND OF THE INVENTION

This patent application relates generally to shock tubes. More specifically, this patent application relates to a sudden release valve for a shock tube.

In general, pneumatically triggered shock tubes were born out of the need for a light weight device to create an acoustic signature for the purpose of improvised explosive device (IED) training. A shock wave may be generated by a sudden pressurization of a sonic orifice. This sudden pressure release of gas from a finite volume plenum may be implemented by triggering a valve opening. Such valve opening creates a shock wave to generate an audible and/or visual signature. Such a signature may include a loud bang, a powder substance release and/or a flash-strobe.

Conventional shock tubes include a cylinder arrangement having a plastic diaphragm separating a low pressure carbon dioxide (CO2) gas chamber and a high pressure CO2 gas chamber. Under predetermined conditions, the diaphragm is exploded open to produce a shock wave that travels down the low pressure section of the cylinder to create a signature. This arrangement typically produces a weak signature. Further, CO2 must always be readily available to re-charge the shock tubes having this arrangement. Additionally, after activation of a shock tube using a breakable diaphragm, the cylinder arrangement is often no longer reusable and must be rebuilt or replaced.

SUMMARY

According to an exemplary embodiment, a shock tube apparatus may include a plenum to hold a volume of gas. The plenum may include a hollow chamber having a first end and a second end located opposite one another along a longitudinal axis, the first end of the chamber defining a shock egress opening. A valve assembly may be positioned at the first end of the chamber to seal the shock egress opening. A piston may be positioned within a recess located at the second end of the chamber. The piston may separate a first volume located between the piston and the first end of the chamber from a smaller second volume located between the piston and the second end of the chamber. A tension supporting rod may connect or couple the valve assembly to the piston. A release valve may be in fluid connection with the second volume and a switch may be operable to open the release valve to release gas from the second volume and trigger opening of the valve assembly to generate a shock wave through the shock egress opening.

In an exemplary embodiment, a bleed orifice may extend through the piston to let gas flow between the first volume and second volume and equalize air pressures in the first volume and the second volume.

In an exemplary embodiment, the air pressures of the first and second volume may be equalized at approximately 140 to 160 psi.

In an exemplary embodiment, the shock tube apparatus may further include a preload spring to bias the valve assembly against the shock egress opening.

In an exemplary embodiment, the switch may be a remotely operated solenoid.

In an exemplary embodiment, the shock tube apparatus may include a sear coupled to the release valve to seal the release valve and second volume prior to operation of the switch. The remotely operated solenoid may be activated by a fire command and subsequently remove the sear to open the release valve.

In an exemplary embodiment, the shock tube apparatus may further include an air inlet valve to fill the plenum with gas.

In an exemplary embodiment, the shock tube apparatus may further include an o-ring seated in an indentation surrounding the shock egress opening. The o-ring may contact the valve assembly to seal the shock egress opening. The valve assembly may compress the o-ring prior to the release of the gas from the second volume, and the o-ring may expand and remain in contact with the valve assembly for a predetermined movement of the valve assembly away from the shock egress opening after the release of the gas from the second volume.

In an exemplary embodiment, the shock tube apparatus may further include a spider coupled to the tension supporting rod and to the chamber to center the valve assembly along the longitudinal axis of the chamber.

In an exemplary embodiment, the shock tube apparatus may further include a powder reservoir coupled to the opening of the chamber to release a powder substance upon release of gas from the shock egress opening.

In an exemplary embodiment, the rod may include a first rod end coupled to the piston and a second rod end defining a plug that slides within a cavity of the valve assembly. Upon the release of the gas from the second volume the plug may slide within the cavity a pre-determined distance before the plug engages the valve assembly and moves the valve assembly away from the shock egress opening.

In an exemplary embodiment, the piston and rod operate in unison and are connected or coupled to the valve assembly by an adjustable travel pickup nut which causes the valve assembly opening to occur with an initial velocity.

According to another aspect of the invention, a method for releasing gas from a shock tube can include sealing an opening of a plenum using a valve assembly. The plenum may include a hollow chamber having a first end and a second end located opposite one another along a longitudinal axis. The first end of the chamber may define the shock egress opening to be sealed. The method may further include pumping the chamber to hold a volume of gas and separating a first volume in the chamber from a second volume using a piston positioned within a recess located at the second end of the chamber. The second volume may be located between the piston and the recess. The method may include triggering a release command using a switch operable to open a valve in fluid connection with the second volume and releasing gas from the second volume though the valve. The method may further include moving the piston into the recess under a force of gas pressure in the first volume. Movement of the piston into the recess may unseal the valve assembly at the opening in the first end of the chamber to release a shock wave through the opening.

In an exemplary embodiment, unsealing the opening may cause at least one of a release of an audible signature, a release of a substance, or a release of a visible signature.

In an exemplary embodiment, the method may include compressing an o-ring prior to the release of the gas from the second volume. The o-ring may be seated in an indentation surrounding the opening and contact the valve assembly to seal the opening at the first end of the chamber. Additionally, the method may include releasing the o-ring after the release of gas from the second volume. The o-ring may remain in contact with the valve assembly for a predetermined movement of the valve assembly away from the opening after the release of the gas from the second volume.

In an exemplary embodiment, the method may further include sliding a rod, coupled to the piston at a first rod end, to move the valve assembly from the opening of the chamber upon release of the gas from the second volume. The rod may further include a second rod end defining a plug that slides within a cavity of the valve assembly. The plug may slide within the cavity a pre-determined distance before the plug engages the valve assembly and moves the valve assembly from the opening of the chamber.

In an exemplary embodiment, releasing gas from the second volume out of the chamber through the valve releases to ambient.

BRIEF DESCRIPTION OF THE DRAWINGS

The foregoing and other features and advantages of the invention will be apparent from the following, more particular, description of various exemplary embodiments including a preferred embodiment of the invention, as illustrated in the accompanying drawings, wherein like reference numbers generally indicate identical, functionally similar, and/or structurally similar elements.

DETAILED DESCRIPTION

Various exemplary embodiments of the invention including preferred embodiments are discussed in detail below. While specific exemplary embodiments are discussed, it should be understood that this is done for illustration purposes only. A person skilled in the relevant art will recognize that other components and configurations can be used without departing from the spirit and scope of the invention.

Figure 1:
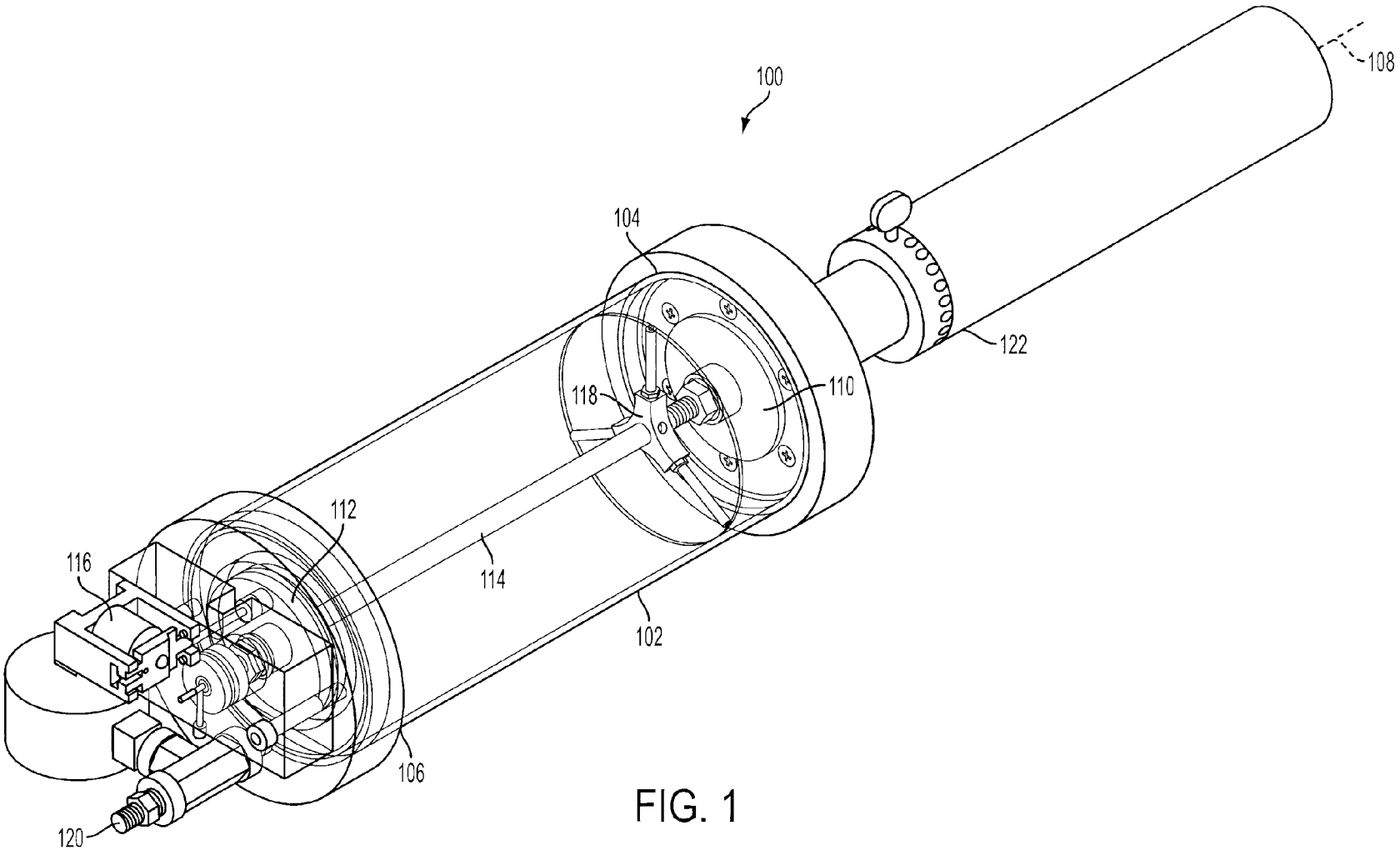
FIG. 1 depicts a top-side perspective view of a shock tube, having a sudden release valve assembly, according to an exemplary embodiment of the present invention.

FIG. 1 depicts a top-side perspective view of a shock tube, having a sudden release valve assembly, according to an exemplary embodiment of the present invention. The shock tube apparatus 100 can include a plenum 102 to hold a volume of gas. The plenum 102 may be a hollow chamber having a first end 104 and a second end 106 located opposite one another along a longitudinal axis 108. The plenum 102 may be cylindrical, as shown, however, other shapes, such as, for example, but not limited to, rectangular, etc., are also possible.

The first end of the chamber may define a shock egress opening 202 (See FIG. 2) for egress of a shock to produce an audible signature, release a powder substance or display a strobe light. A valve assembly 110 may be positioned at the first end 104 of the chamber to seal the shock egress opening 202. The valve assembly 110 may be co-axially mounted within the plenum 102 to enhance air flow symmetry. The valve assembly 110 may be aerodynamically shaped and may include, for example, a 1.75" valve, for use with a 1.55" diameter seal at the shock egress opening 202.

A piston 112 may be positioned within a recess 302 (See FIG. 3) located at the second end 106 of the chamber. The piston 112 may separate a first volume 204 in the chamber from a smaller second volume 206 (See FIG. 2) located between the piston 112 and the second end 106 of the chamber. A tension supporting rod 114 may be positioned along the longitudinal axis 108 within the plenum 102 to connect or couple the valve assembly 110 to the piston 112 to coordinate movement of the rod 114 and piston 112 along the longitudinal axis 108. The valve assembly 110 and piston 112 may be rigidly interconnected by the rod 114. The rod may be a 0.25" diameter force tension rod of low mass.

Figure 2:
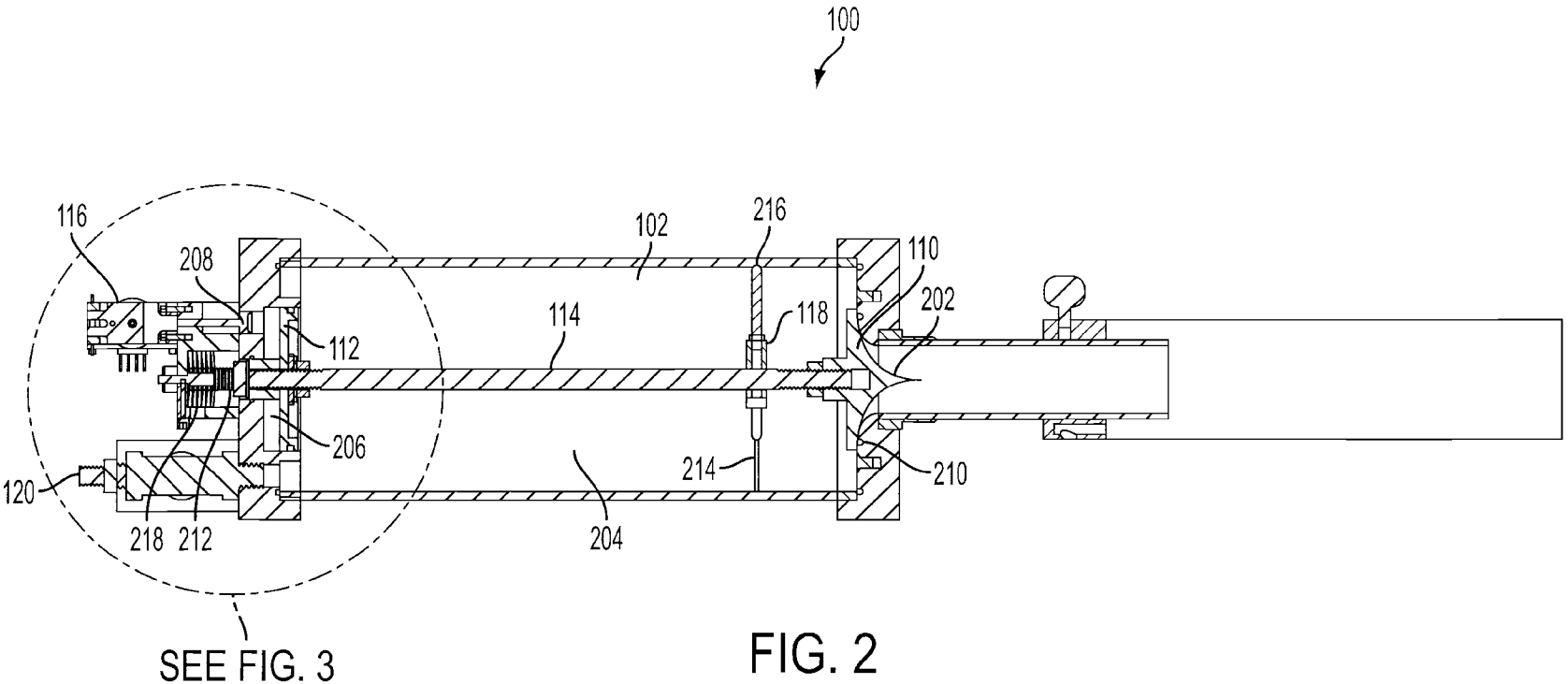
FIG. 2 depicts a cross-sectional view of a shock tube, having a sudden release valve assembly, according to an exemplary embodiment of the present invention.
Figure 3:
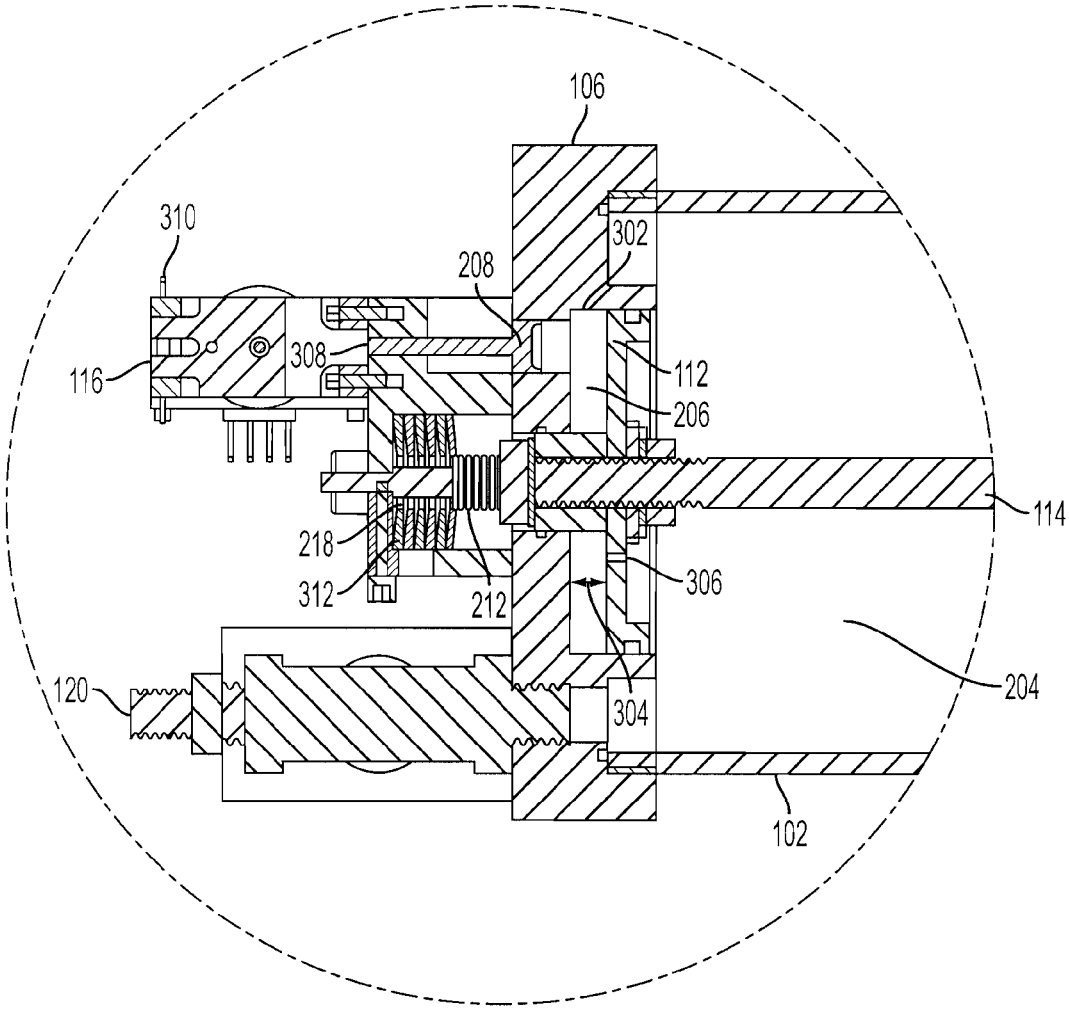
FIG. 3 depicts an enlarged cross-sectional view of the piston-end of the shock tube of FIG. 2.

As shown in FIGS. 2 and 3, a release valve 208, for example a dump valve or dump piston, may be in fluid connection with the second volume 206 to release gas therefrom. A switch 116, for example a solenoid, may be operable to open the release valve 208 to release gas from the second volume 206 and trigger rapid opening of the valve assembly 110 to generate a shock wave, as will be discussed in more detail below.

To prepare the shock tube apparatus 100 for use, the plenum 102 may be pressurized with gas through air inlet 120 to pressurize the first volume 204 and the second volume 206. For example, shock tube apparatus 100 may include an air inlet 120, such as a one-way or check valve, to fill the plenum 102 with the volume of gas, for example, using an air compressor and pressure gauge. The air compressor and/or pressure gauge can be part of the shock tube apparatus 100, or alternatively can be separate components.

Referring to FIG. 3, the shock tube apparatus 100 can further include a bleed orifice 306 extending through the piston 112 to let gas flow between the first volume 204 and second volume 206, and, for example, to equalize air pressures in the first volume 204 and the second volume 206. The bleed orifice 306 can have, for example, a 1/32" diameter. The bleed orifice 306 can allow the pressure in the second volume 206 to equilibrate with the pressure in the first volume 204 during plenum re-pressurization, for example, through inlet 120.

According to an exemplary embodiment, the air pressures of the first volume 204 and second volume 206 may be equalized at approximately 140 to 160 psi, however other pressures are possible, and may depend, for example, on the size and configuration of the shock tube apparatus.

Referring to FIG. 3, the piston 112 may include, for example, a 1.75" force balancing piston mounted on the rod 114. The piston 112 may be guided on its diameter in the recess 302 at the second end 206 of the plenum 102 to form the second volume of gas 206, alternatively called the trigger-dump-volume. The recess 302 may be just deep enough to contain the piston thickness plus the required valve opening stroke 304, however other configurations are possible.

Dependent on the valve opening stroke 304, the second volume 206 of gas may be, for example, approximately 0.31 cubic-inches.

In the exemplary embodiment, because pressure is equalized across both sides of the piston 112, there may be zero net force of the piston 112 acting on the rod 114. At the first end 104 of the plenum 102, the full pressure of the first volume 204 may act upon the valve assembly 110 to provide a force (for example, approximately 1.91 times plenum pressure), which serves to tightly seal the shock egress opening 202. An o-ring 210 may be provided around the shock egress opening 202. As discussed in more detail in paragraph 0042, the force may compress the o-ring 210 by about 5 to 10 mils.

According to FIG. 3, a sear 308 may be removably coupled to the release valve 208 to counteract the air pressure force on the release valve 208 from second volume 206. The sear 308 may be positioned at the opposite end of the release valve 208 from the second volume 206. The sear 308 may serve as a stop to prevent the release valve 208 from moving back towards the switch 116 and venting the second volume 206. Further a pivot 310 may be coupled to the switch 116 and may remove the sear 308 from contact with the release valve 208 upon activation of the switch 116. When the sear 308 is released, the air pressure in the second volume 206 may push the release valve 208 out of the second end 106 of the plenum 102 to allow the second volume 206 to vent to ambient.

Figure 4:
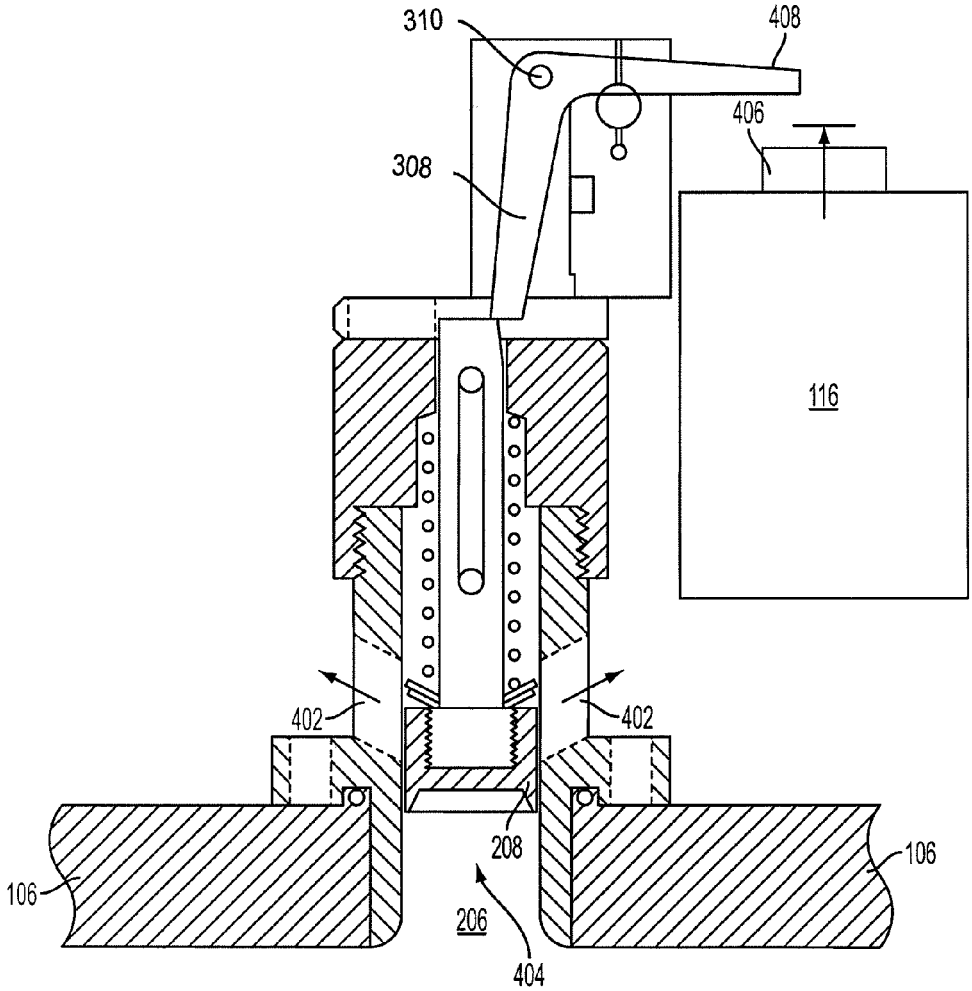
FIG. 4 depicts a cross-sectional view of the trigger mechanism of a shock tube, having a sudden release valve assembly, according to an exemplary embodiment of the present invention.

FIG. 4 depicts a cross-sectional view another trigger mechanism, according to an exemplary embodiment of the present invention. As shown in FIG. 4, the release valve 208 may, for example, be a dump piston and the switch may be a remotely operated trigger solenoid 116, or relay armature (i.e. a trip wire). A sear 308 may further be coupled to the release valve 208 to seal the release valve 208 and second volume 206 prior to operation of the switch 116. The relay or solenoid 116 may be an electro-mechanical device with a magnetic coil to induce flux in a moving armature 406 for the purpose of releasing the sear 308. The coil can be driven by a battery of sufficient voltage and low internal impedance, or alternatively may be driven by a small battery of sufficient voltage whose output is buffered with a capacitor of sufficient capacitance to maintain adequate coil voltage until the solenoid 116 has operated. The remotely operated solenoid 116 may be activated by a fire command.

When the solenoid 116 is actuated, the armature 406 of the solenoid 116 may accelerate upwardly, approximately 0.01 inches, to impact the sear lever 408 which subsequently may cause the sear 308 to open the release valve 208. Removal of the sear 308 may allow the release valve 208, or dump piston, to retract out of a bore 404 in the second end 206 of the chamber 102 to allow the second volume 206 to vent to the ambient through vents 402. As an example, the switch 116 may be a trigger solenoid having a 6.9 Ohm coil that produces adequate armature force to un-sear an approximately seven pound load on the release valve 208, for example a 0.25" diameter dump piston, with, for example, but not limited to, nine volts excitation.

According to an exemplary embodiment, activation of the shock tube apparatus 100 may be initiated by sudden pressure release behind the piston 112, e.g. the opening the release valve 208 to vent the second volume 206 to ambient pressure. In the above example, the 0.25" diameter dump piston, i.e. the release valve 208, can have a load of seven pounds due to a 140 psi second volume 206 pressure. This load may be counteracted by the pivot 310 and sear 308, which is the armature of the switch 116, or small trigger solenoid.

According to an exemplary embodiment, opening the release valve 208 to ambient rapidly drops the pressure of the second volume 206 behind the piston 112 to ambient, leaving the full first volume 204 pressure on the tension rod 114 side of the piston 112. This pressure acting on only one side of the piston 112 can create an overwhelming force in the rod 114 to rapidly open the valve assembly 110. Specifically, when the trigger 116 is activated the release valve 208 may be unseared and may accelerate a pre-determined distance, for example ⅛ inch, before the second volume 206, which is, for example, 0.31 cubic inches, becomes vented, which may enhance rapid opening of the vents 402, or dump paths, by providing dump piston velocity at the beginning (time zero) of the second volume 206 venting. According to an exemplary embodiment, the 0.25" diameter path of the valve 206 has 64 times the area of the exemplary 1/32" bleed orifice 306, and accordingly, the second volume 206 egress flow greatly overwhelms the bleed orifice 306 ingress flow during the triggered actuation event. The triggered venting may create a rapidly rising differential force imbalance across the piston 112, having, for example, a 1.75" diameter, amounting to 2.4 times plenum pressure. A net differential piston-to-valve assembly area of 0.5 square inches can produce a net valve assembly opening force of about 0.5 times the plenum pressure. Thus, at 140 psi plenum pressure, approximately a 70 pound force may be applied to the valve assembly 110 (0.159 LBM) during actuation that may produce approximately 440 g's at the valve assembly 110 opening acceleration.

Figure 5:
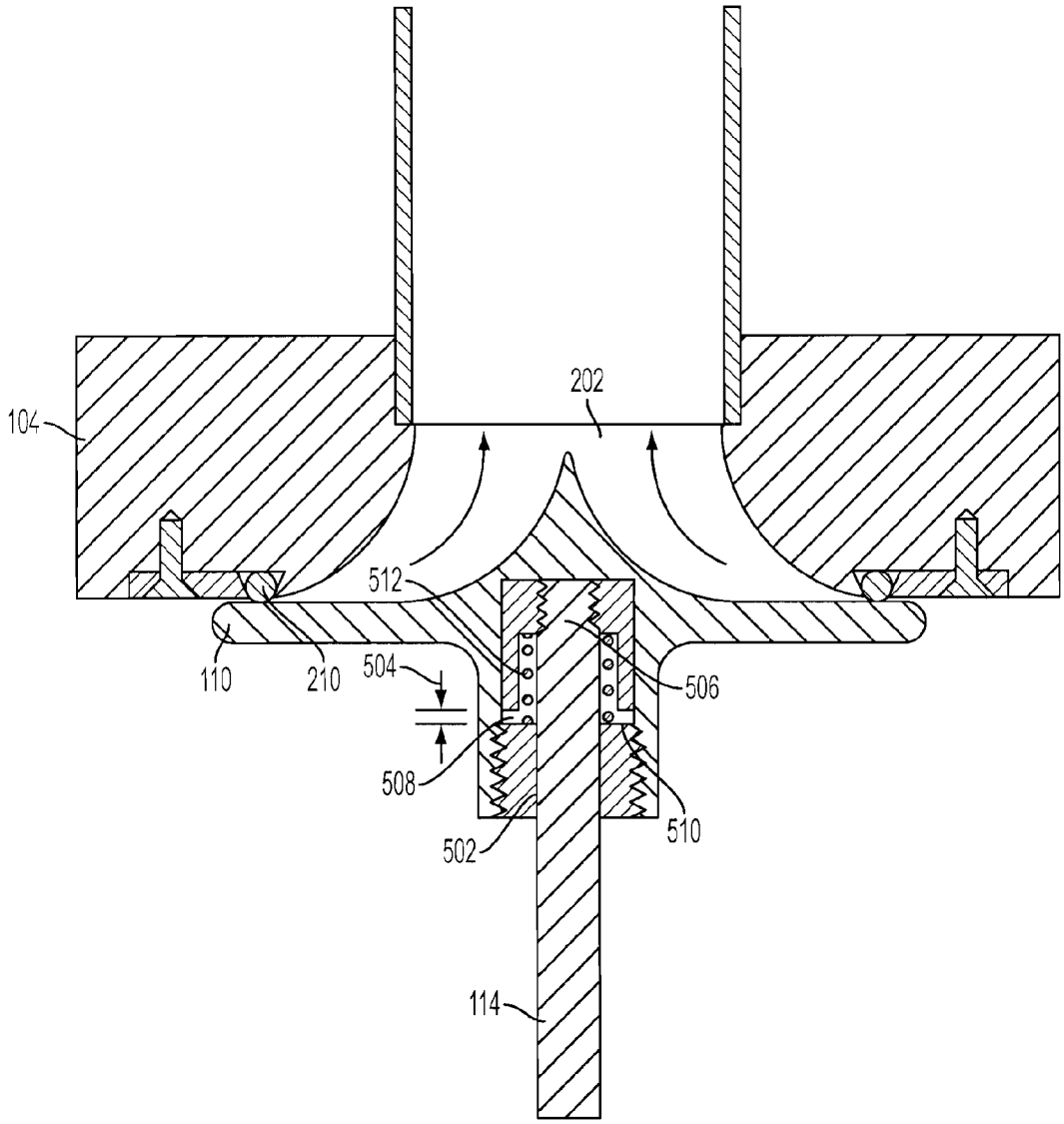
FIG. 5 depicts a cross-sectional view of the sudden release valve assembly of a shock tube according to an exemplary embodiment of the present invention.

FIG. 5 depicts a cross-sectional view of the sudden release valve assembly of a shock tube according to an exemplary embodiment of the present invention. As discussed above, the shock tube apparatus 100 may include an o-ring 210 seated in an indentation surrounding the shock egress opening 202. The o-ring 210 can have a diameter larger than the depth of the indentation, such that a portion of the o-ring extends out of the indentation. The part of the o-ring 210 extending from the indentation may contact the valve assembly 110 to seal the shock egress opening 202 at the first end 104 of the plenum 102. The valve assembly 110 may compress the o-ring 210 prior to the release of the gas from the second volume 206 and the o-ring 210 may expand and remain in contact with the valve assembly 110 for a period of time after the release of the gas from the second volume 206, for example, to allow the valve assembly 110 to accelerate for a period of time before the valve assembly 110 unseals from the shock egress opening 202.

During use of the shock tube apparatus 100, generally when the closed valve assembly 110 begins to open, for example, upon triggering the apparatus, the valve assembly 110 begins motion from zero velocity. The effect of gradual opening from zero velocity may be throttling, or reduced flow, until a full open stroke is achieved. Producing acoustic shock requires "sudden" opening, the sudden opening having a small but non-zero initial velocity. Thus, to avoid undesirable throttling at the valve assembly 110, as well as the release valve 208, the speed of valve opening can be enhanced by accelerating the valve prior to the when valve flow is permitted. In the case of release valve 208, this may be achieved by making the release valve 208 an obturating piston (see FIG. 4 depicting a dump piston, in a bore 404). During initial motion, the piston obturator seals and prevents flow until the piston leaves the bore 404.

Additionally, or alternatively, the o-ring 210 can help prevent throttling. As stated above, plenum pressure operating on the valve assembly 110 can compress the captured valve seal o-ring 210 at, for example, five to ten mils. Upon triggering the apparatus, the o-ring 210 can expand by the amount of its compression, thereby allowing the valve assembly to move and accelerate prior to the shock egress opening 202 becoming unsealed and flow commencing. Numerical analysis shows that the valve assembly 110 can attain an appreciable initial velocity during the motion of unloading the elastic o-ring 210 before flow commences. This initial acquired velocity can significantly reduce time for the valve assembly 110 to move from zero flow to being fully open.

Referring to FIG. 5, the rod 114 can include a first rod end (not shown) coupled to the piston 112 and a second rod end 506 defining a plug, or a slip fit 502, that slides within a cavity 508 of the valve assembly 110. The slip fit 502 may slide in the cavity 508 a predetermined distance 504 before engaging an end surface 510 of the cavity 508. Upon the release of the gas from the second volume 206, the plug can slide within the cavity 508 a pre-determined distance 504 (referred to as an "adjustable pre-travel gap") before the plug engages the end surface 510 and moves the valve assembly 110 from the shock egress opening 202 of the chamber 102, thereby allowing the valve assembly 110 to accelerate before flow through the shock egress opening 202 commences.

For example, as shown in FIG. 5, a second end 506 of the rod 114 is threaded into a larger cavity 508 of the valve assembly 110. When the gas in the second volume 206 is released, the piston 112 and the rod 114 may move downward into the recess 302 of the second end 106 of the chamber 102 causing the rod 114 to move a pre-determined distance 504 before engaging the valve assembly 110 to jerk open the shock egress opening 202 of the chamber 102 and release the shock wave.

After triggering the shock tube apparatus 100, the valve assembly 110 may decelerate back into starting position. As an example, if the valve assembly 110 weighs approximately 0.159 pounds, at 140 psi plenum pressure the valve assembly 110 may attain a velocity of 17.2 feet/second and energy of 0.73 pounds/inch during opening. In order to absorb this energy and preserve the shock tube apparatus 100, a series parallel stack of spring washers 218 (see FIG. 2) may be provided to dissipate the energy in approximately 10 mils of travel at the end of the stroke. The washers 218 may help minimize damaging inertial forces on the active valve components. Further, a small helical compression spring 512 associated with the valve assembly 110 may push the valve assembly 110 back into closed position after the plenum 102 is exhausted. An additional small helical compression spring 312 may reinsert the release valve 208 back into the bore 404 and reset the sear 308 following resetting of the valve assembly 110, as shown in FIG. 4.

Referring to FIG. 2, the shock tube apparatus 100 may further include a co-axial spider 118, for example a concentric tri-leg spider, coupled to the circumference of the rod 114 and to the plenum 102. The spider 118 may provide longitudinal freedom and concentric radial constraint to the rod 113 and may center the valve assembly 110 along the longitudinal axis 108 of the plenum 102 or chamber. For example, the spider 118 can include a plurality of legs 214 extending from the rod 114 to a groove 216 or other feature on the inner surface of the plenum 102.

Referring to FIGS. 1 and 2, the shock tube apparatus 100 may further include a powder reservoir 122 coupled to the shock egress opening 202 of the chamber 102 to release a powder substance upon release of the gas from the second volume 206. For example, a venturi fitted concentric to the shock tube may produce a sufficient draft to disperse smoke simulation powder. The powder reservoir 122 may be removably attached to the shock tube apparatus 100, for example, using thumb screws or other features.

According to an exemplary embodiment, the shock tube apparatus 100 may further include a preload spring 212 to bias the valve assembly 110 against the shock egress opening 202 of the plenum 102, for example, to seal the plenum 102 for re-pressurization after use.

The present invention also relates to a method for suddenly releasing a shock tube apparatus 100. The method may involve sealing a shock egress opening 202 of a plenum 101 using a valve assembly 110. As discussed above, the plenum 102 can include a hollow chamber having a first end 104 and a second end 106 located opposite one another along a longitudinal axis 108. The first end 104 of the chamber 102 can define the shock egress opening 202 to be sealed.

The method may include pressurizing the chamber 102 to hold a volume of gas. The gas may be pumped into the chamber 102 via air inlet 120 using an air compressor or other similar device. According to an exemplary embodiment, the chamber 102 may be pumped to an air pressure of approximately 140 to 160 psi.

The method may further include separating a first volume 204 in the chamber 102 from a second volume 206 using a piston 112 positioned within a recess 302 located at the second end 106 of the chamber 102. The second volume may be located between the piston 112 and chamber 102. The piston may further include a bleed orifice 306 to equalize the pressure between the first volume 204 and the second volume 206.

Next, the method may include triggering a release command using a switch 116 operable to open a release valve 208 in fluid connection with the second volume 206. The switch 116 may be a remotely operated solenoid and the remote command equipment may include anything that can command a circuit closure to a solenoid or relay coil.

Further, the method may include releasing gas from the second volume 206 out of the chamber 102 though the release valve 208. The release valve 208 may include a sear 308 coupled to the release valve 208 to seal the release valve 208 and the second volume 206 prior to operation of the switch 116. Thus, when the remotely operated solenoid, or switch 116, is activated by a fire command the sear 308 may be subsequently removed to open the release valve 208, and release gas from the second volume 206.

The method may include moving the piston 112 into the recess 302 under a force of gas pressure in the first volume 204, wherein movement of the piston 112 into the recess 302 may unseal the valve assembly 110 at the shock egress opening 202 in the first end 104 of the chamber 102 to release a shock wave through the shock egress opening 202.

According to a further exemplary embodiment, the step of unsealing the shock egress opening 202 may cause a release of an audible signature, a release of a substance and/or a release of a visible signature.

According to another exemplary embodiment, the method may include the further step of compressing an o-ring 210 prior to the release of the gas from the second volume 206. The o-ring 210 may be seated in an indentation surrounding the shock egress opening 202 and may contact the valve assembly 110 to seal the shock egress opening 202 at the first end 104 of the chamber 102. Further the method may include releasing the o-ring 210 after the release of gas from the second volume 206, where the o-ring 210 remains in contact with the valve assembly 110 for a period of time after the release of the gas from the second volume 206, thereby allowing the valve assembly 110 to accelerate.

According to a further exemplary embodiment, the method may include the step of sliding a rod 114, coupled to the piston 112 at a first rod end (not shown), to move the valve assembly 110 from the shock egress opening 202 of the chamber 102 upon release of the gas from the second volume 206. The rod 114 may further include a second rod end 506 defining a plug that slides within a cavity 508 of the valve assembly 110. The plug may slide within the cavity 508 a pre-determined distance 504 before the plug engages the valve assembly 110 and moves the valve assembly 110 from the shock egress opening 202 of the chamber.

Another exemplary embodiment may include the method step of releasing gas from the second volume 206 out of the chamber 102 though the release valve 208 and into the ambient.

Figure 6:
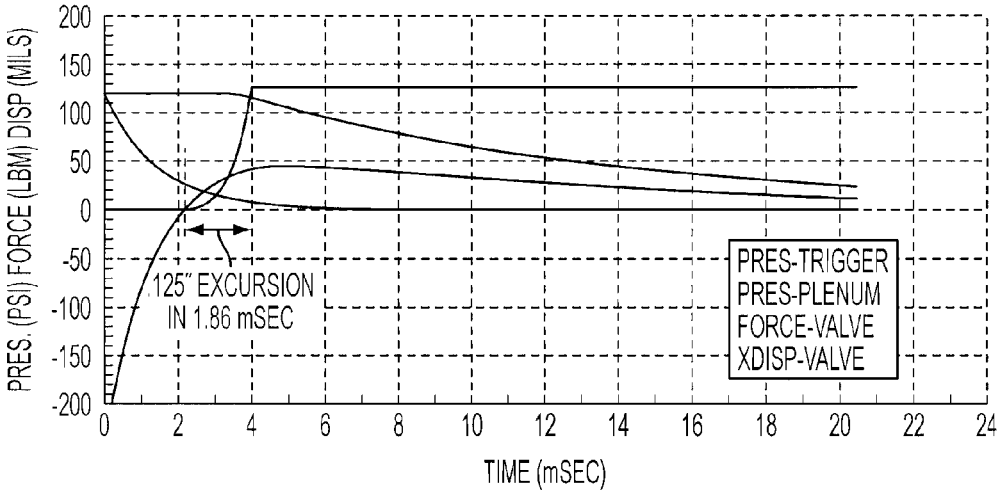
FIG. 6 depicts a graph showing the pressure force versus the time during opening of the sudden release valve assembly according to an exemplary embodiment of the present invention.

FIG. 6 depicts a graph showing the pressure force and the release time during opening of an exemplary sudden release valve assembly according to an exemplary embodiment of the present invention. Computer analysis may be performed using program Shock2.BAS based on inviscid isentropic flow. Such a program may analyze valve action using a computer code which allows a variation of shock tube parameters. Such parameters may include, for example, but not limited to diameter of the valve seal, diameter of the force balancing piston, valve opening stroke, pressure drop in ancillary volume, pressure drop in working plenum volume and mass of the valve assembly, etc. FIG. 6 shows the results of such an analysis for a shock tube apparatus having a 0.832 inch diameter. As shown, the valve opening time was approximately 1.86 milliseconds and the valve impact velocity was approximately 15.07 feet/second.

The present invention allows for a self-resetting blast effect that can be placed on an IED training lane and fired by the currently fielded Fire Marker Units repeatedly throughout the training day without requiring the post-fire servicing that is necessary for current non-pyrotechnic IED solutions. Further, instructors may utilize the same control and firing devices currently fielded with the pyrotechnic training system with this device replacing the pyrotechnic charge. All training capabilities and functionality of the current equipment retained without the range requirements mandated by the use of pyrotechnic munitions.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A shock tube apparatus comprising:

a plenum to hold a volume of gas, wherein the plenum comprises a hollow chamber having a first end and a second end located opposite one another along a longitudinal axis, the first end of the chamber defining a shock egress opening;

a valve assembly positioned at the first end of the chamber to seal the shock egress opening;

a piston positioned within a recess located at the second end of the chamber, wherein the piston separates a first volume located between the piston and the first end of the chamber from a smaller second volume located between the piston and the second end of the chamber;

a tension supporting rod that connects or couples the valve assembly to the piston;

a release valve in fluid connection with the second volume; and a switch operable to open the release valve to release gas from the second volume and trigger opening of the valve assembly to generate a shock wave through the shock egress opening.

2. The apparatus of claim 1, further comprising a bleed orifice extending through the piston to let gas flow between the first volume and second volume and equalize air pressures in the first volume and the second volume.

3. The apparatus of claim 2, wherein the air pressures of the first and second volume are equalized at approximately 140 to 160 psi.

4. The apparatus of claim 1, further comprising a preload spring to bias the valve assembly against the shock egress opening.

5. The apparatus of claim 1, wherein the switch comprises a remotely operated solenoid.

6. The apparatus of claim 5, further comprising a sear coupled to the release valve to seal the release valve and second volume prior to operation of the switch, wherein the remotely operated solenoid is activated by a fire command and subsequently removes the sear to open the release valve.

7. The apparatus of claim 1, further comprising an air inlet valve to fill the plenum with gas.

8. The apparatus of claim 1, further comprising an o-ring seated in an indentation surrounding the shock egress opening, wherein the o-ring contacts the valve assembly to seal the shock egress opening.

9. The apparatus of claim 8, wherein the valve assembly compresses the o-ring prior to the release of the gas from the second volume, and the o-ring expands and remains in contact with the valve assembly for a predetermined movement of the valve assembly away from the shock egress opening after the release of the gas from the second volume.

10. The apparatus of claim 1, further comprising a spider coupled to the tension supporting rod and to the chamber to center the valve assembly along the longitudinal axis of the chamber.

11. The apparatus of claim 1, further comprising a powder reservoir coupled to the opening of the chamber to release a powder substance upon release of gas from the shock egress opening.

12. The apparatus of claim 1, wherein the rod includes a first rod end coupled to the piston and a second rod end defining a plug that slides within a cavity of the valve assembly.

13. The apparatus of claim 12, wherein upon the release of the gas from the second volume the plug slides within the cavity a pre-determined distance before the plug engages the valve assembly and moves the valve assembly away from the shock egress opening.

14. The apparatus of claim 1, wherein the piston and rod operate in unison and are connected or coupled to the valve assembly by an adjustable travel pickup nut which causes the valve assembly opening to occur with an initial velocity.

15. A method for releasing gas from a shock tube, the method comprising:

sealing an opening of a plenum using a valve assembly, wherein the plenum comprises a hollow chamber having a first end and a second end located opposite one another along a longitudinal axis, and wherein the first end of the chamber defines the opening to be sealed;

pumping the chamber to hold a volume of gas;

separating a first volume in the chamber from a second volume using a piston positioned within a recess located at the second end of the chamber, wherein the second volume is located between the piston and the recess;

triggering a release command using a switch operable to open a valve in fluid connection or coupling with the second volume;

releasing gas from the second volume though the valve; and moving the piston into the recess under a force of gas pressure in the first volume, wherein movement of the piston into the recess unseals the valve assembly at the opening in the first end of the chamber to release a shock wave through the opening.

16. The method of claim 15, wherein unsealing the opening causes at least one of a release of an audible signature, a release of a substance, or a release of a visible signature.

17. The method of claim 15, further comprising:

compressing an o-ring prior to the release of the gas from the second volume, wherein the o-ring is seated in an indentation surrounding the opening and contacts the valve assembly to seal the opening at the first end of the chamber; and releasing the o-ring after the release of gas from the second volume, wherein the o-ring remains in contact with the valve assembly for a predetermined movement of the valve assembly away from the opening after the release of the gas from the second volume.

18. The method of claim 15, further comprising sliding a rod, coupled to the piston at a first rod end, to move the valve assembly from the opening of the chamber upon release of the gas from the second volume, wherein the rod further includes a second rod end defining a plug that slides within a cavity of the valve assembly, and wherein the plug slides within the cavity a pre-determined distance before the plug engages the valve assembly and moves the valve assembly from the opening of the chamber.

19. The method of claim 15, wherein releasing gas from the second volume out of the chamber though the valve releases to ambient.

* * * * *